US005350322A

United States Patent [19]

Kondo

[11] Patent Number: 5,350,322

[45] Date of Patent: Sep. 27, 1994

[54] BULB SOCKET TERMINAL

[75] Inventor: Hiroyuki Kondo, Haibara, Japan

[73] Assignee: Yazaki Corporation, Tokyo, Japan

[21] Appl. No.: 113,360

[22] Filed: Aug. 30, 1993

Related U.S. Application Data

[63] Continuation of Ser. No. 734,110, Jul. 24, 1991, abandoned, which is a continuation of Ser. No. 483,173, Feb. 22, 1990, abandoned.

[51] Int. Cl.[5] ..... H01R 13/207

[52] U.S. Cl. ..... 439/862; 439/667; 439/736

[58] Field of Search ..... 439/736, 862, 606, 666, 439/667, 641, 643, 647, 648

[56] References Cited

U.S. PATENT DOCUMENTS 4,729,739 3/1988 Coffee et al. ..... 439/862
4,940,432 7/1990 Consoli et al. ..... 439/862

FOREIGN PATENT DOCUMENTS 59-79990 5/1984 Japan .

*Primary Examiner*—Gary F. Paumen
*Attorney, Agent, or Firm*—Armstrong, Westerman, Hattori, McLeland & Naughton

[57] ABSTRACT

A bulb socket terminal to be accommodated in a socket body of a connector bulb socket. The terminal includes a base, an elastic contact portion adapted to contact a filament or an earth of a bulb on one side of said base, and a connecting portion adapted to be connected to a connector on the other side thereof. The bulb socket terminal is integrally formed intermediate of the elastic contact portion and the connecting portion with a resin flow blocking wall which contacts an insert-molding metal mold to seal an area of the elastic contact portion at the time of insert-molding. Accordingly, the area where the elastic contact portion extends is sealed by the rein flow blocking wall at the time of insert-molding with use of the metal mold to thereby prevent the resin from flowing into this area. Therefore, the spring elasticity of the elastic contact portion will not be restricted.

3 Claims, 5 Drawing Sheets

BULB SOCKET TERMINAL

This application is a continuation of application Ser. No. 07/734,110 filed Jul. 24, 1991, now abandoned, which in turn is a continuation of application Ser. No. 07/483,173 filed Feb. 22, 1990, now abandoned.

BACKGROUND OF THE INVENTION

1. Field of the Invention

The present invention relates to a bulb socket terminal in an automotive lamp, and more particularly to a terminal having a structure which may be insert-molded in a socket body.

2. Description of the Relevant Art

Conventionally, a technique of insert-molding a terminal in a housing body of a connector is known, but a technique of insert-molding a bulb socket terminal in a bulb socket with a connector has not yet been established.

Japanese Utility Model Laid-open Publication No. 59-79990 discloses a connector bulb socket as shown in FIGS. 8 to 12. Referring to FIGS. 8 to 12, the bulb socket is constructed of a socket body A, a terminal C adapted to contact a filament end $B_1$ of a bulb B, and a ground terminal D adapted to contact a ground end $B_2$ of the bulb B. The socket body A, the terminal C and the ground terminal D are independently manufactured before both the terminals C and D are received through a bulb insert hole a and secured in said socket body A.

Referring to FIGS. 13A and 13B, if the terminal C to contact the filament end $B_1$ is insert-molded in the socket body A, a metal mold $E_1$ may be used for enclosing a contact portion b adapted to elastically contact the filament end $B_1$. In this case, if resin is filled in a hatched area G (corresponding to the socket body A) alone to secure the terminal C, there will be no problem. However, the resin actually flows also into a hatched area H because there is no wall or the like for inhibiting intrusion of the resin. (Although another metal mold to be coupled with the metal mold $E_1$ is actually provided on the opposite side of the metal mold $E_1$ with respect to the hatched area G, such a metal mold is not shown for the simplicity of the drawing.) For the above-mentioned reason, an amount of elastic displacement of the contact portion b is restricted to cause insufficient electric contact with the filament $B_1$. To prevent the intrusion of the resin into the hatched area H, it may be considered to form the contact portion b into an S-shaped contact portion c as shown in FIGS. 14A and 14B. However, there remains a problem such that the resin still flows into an area of the contact portion c as shown by the arrows through a necessary clearance between the terminal C and a metal mold $E_2$ or a gap therebetween due lack of uniformity in finished sizes of the terminal C.

In case of insert-molding the ground terminal D, it may be considered to enclose a contact portion d adapted to contact the ground end by means of a metal mold F as shown in FIGS. 15A and 15B. However, the resin will flow into not only the hatched area G but also a hatched area J for the same reason as the above. As a result, the contact portion d is secured by the resin molded in said hatched area J, thus causing a problem that the bulb cannot be inserted.

SUMMARY OF THE INVENTION

It is accordingly an object of the present invention to provide a bulb socket terminal having a structure which can be insert-molded in a socket body of a connector bulb socket.

According to the present invention, there is provided a bulb socket terminal to be accommodated in a socket body of a connector bulb socket, said terminal including a base plate, an elastic contact portion adapted to contact a filament or a ground of a bulb on one side of said base plate, and a connecting portion adapted to be connected to a connector on the other side thereof. The bulb socket terminal is integrally formed intermediate of said elastic contact portion and said connecting portion with a resin flow blocking wall which contacts an insert-molding metal mold to seal an area of said elastic contact portion at the time of insert-molding.

As mentioned above, the resin flow blocking wall is formed at an intermediate between the elastic contact portion adapted to contact the bulb and the connecting portion adapted to be connected to a connector, so that the area of the elastic contact portion may be sealed by the resin flow blocking wall upon insert-molding with use of a metal mold to thereby inhibit the resin flow into this area. Therefore, the spring elasticity of the elastic contact portion will not be restricted.

Other objects and features of the invention will be more fully understood from the following detailed description and appended claims when taken with the accompanying drawings.

DETAILED DESCRIPTION OF THE PREFERRED EMBODIMENTS

There will now be described a preferred embodiment of the present invention with reference to the drawings.

Figure 1:
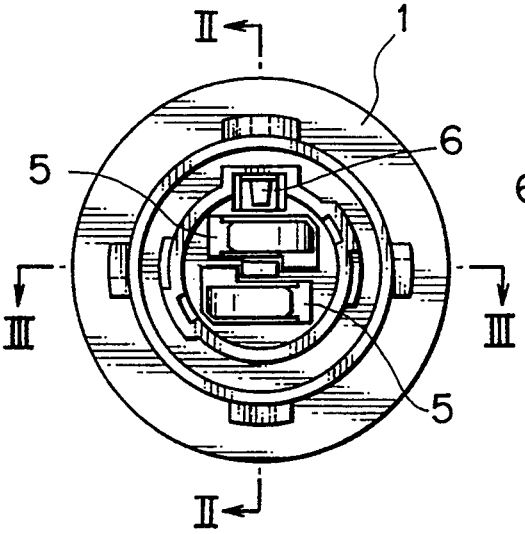
FIG. 1 is an elevational view of the bulb socket terminal of the present invention as fixedly accommodated in the socket body by insert-molding.
Figure 2:
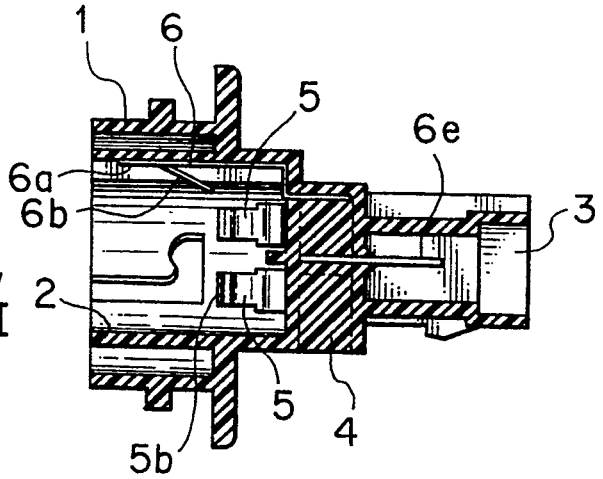
FIG. 2 is a cross section taken along the line II—II in FIG. 1.
Figure 3:
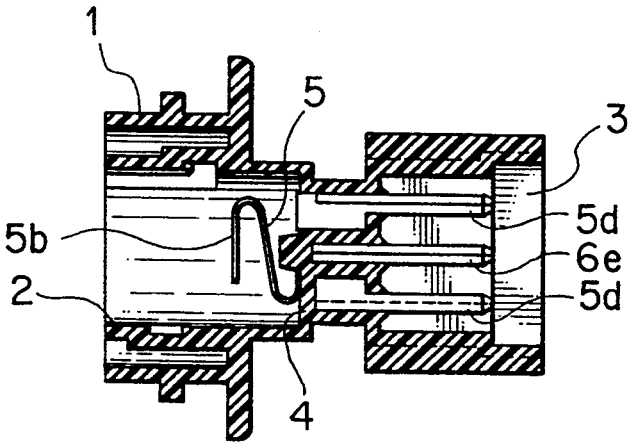
FIG. 3 is a cross section taken along the line III—III in FIG. 1.
Figure 8:
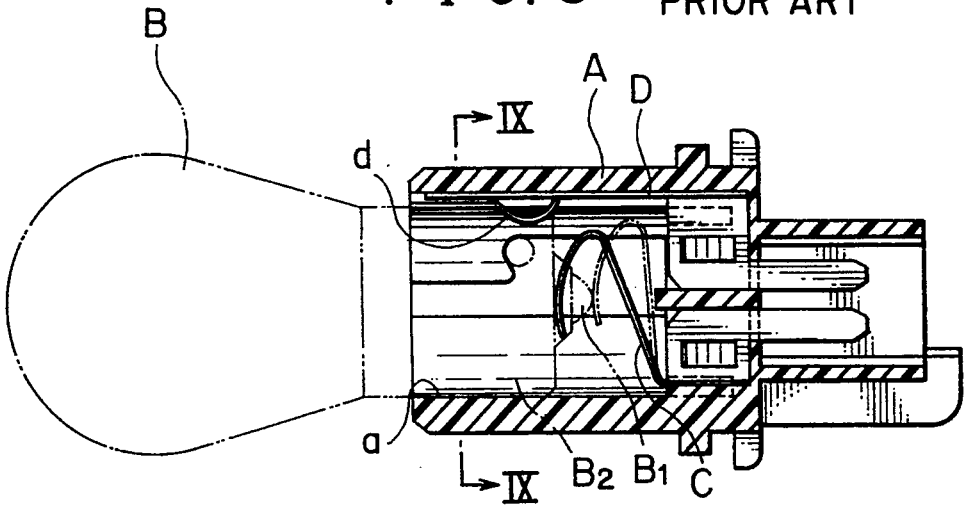
FIG. 8 PRIOR ART
FIG. 8 is a vertical sectional view of the bulb socket in the prior art.
Figure 9:
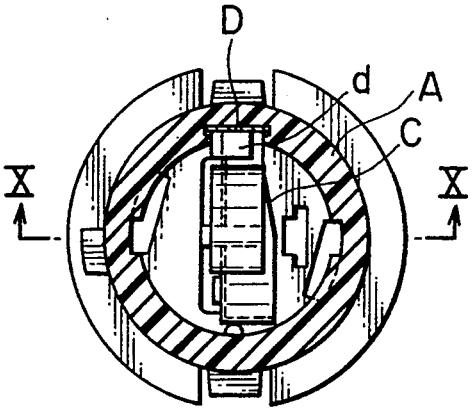
FIG. 9 PRIOR ART
FIG. 9 is a cross section taken along the line IX—IX in FIG. 8.
Figure 10:
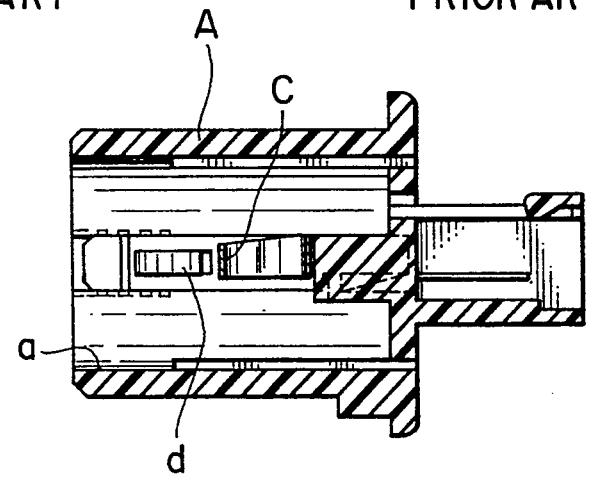
FIG. 10 PRIOR ART
FIG. 10 is a cross section taken along the line X—X in FIG. 9.
Figure 13A:
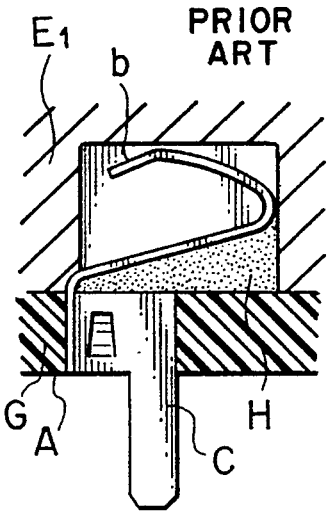
FIG.13A PRIOR ART
FIG. 13A is an elevational view of the terminal C of the prior art upon insert-molding with a metal mold shown in section.
Figure 13B:
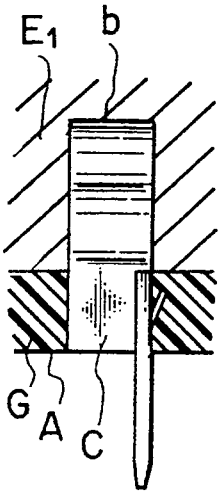
FIG.13B PRIOR ART
FIG. 13B is a side view of FIG. 13A.
Figure 14A:
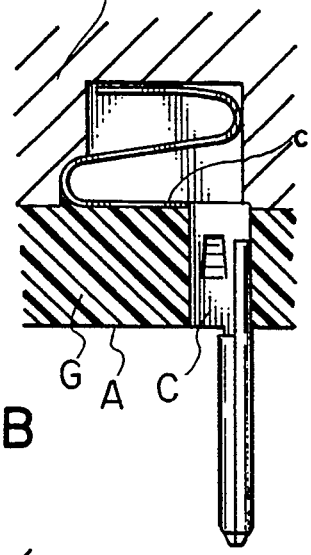
FIG.14A PRIOR ART
FIG. 14A is an elevational view of an improved form of the terminal C of the prior art upon insert-molding with a metal mold shown in section.
Figure 14B:
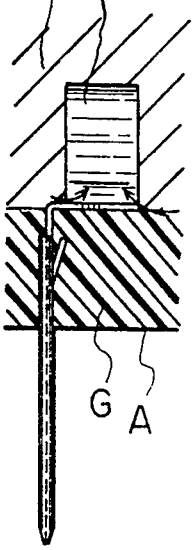
FIG.14B PRIOR ART
FIG. 14B is a side view of FIG. 14A.
Figure 15A:
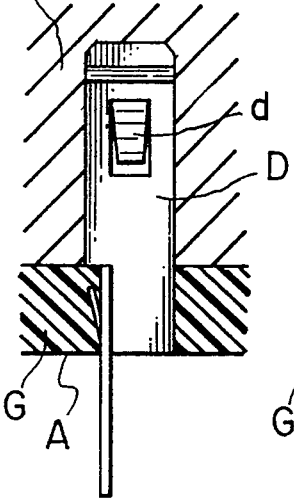
FIG.15A PRIOR ART
FIG. 15A is an elevational view of the ground terminal D of the prior art upon insert-molding with a metal mold shown in section.
Figure 15B:
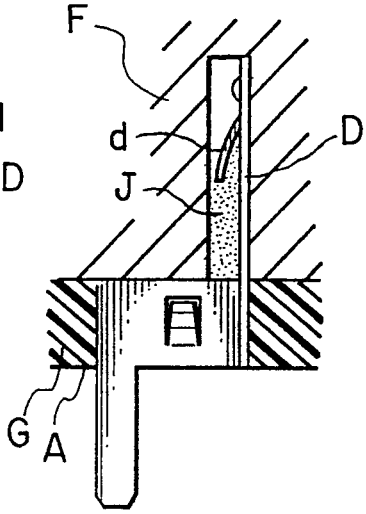
FIG.15B PRIOR ART
FIG. 15B is a side view of FIG. 15A.

Referring to FIGS. 1 to 3, reference numeral 1 designates a socket body integrally formed of a synthetic resin. The socket body 1 has a bulb insertion hole 2 at one end thereof and a connector insertion hole 3 at the other end. The socket body 1 is formed with a central partition wall 4, in which a pair of terminals 5 to contact a filament end of a bulb (see FIG. 8) and a ground terminal 6 to contact a ground end of the bulb are fixedly received by insert-molding in the socket body 1.

Figure 4A:
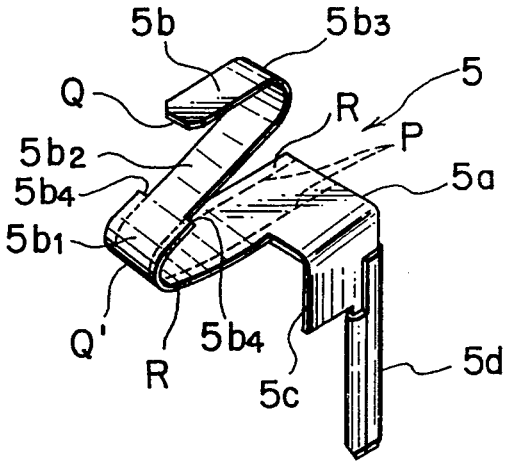
FIG. 4A is an enlarged perspective view of the terminal 5 shown in FIG. 1.

Referring to FIG. 4A, the terminal 5 is integrally formed from a single thin sheet metal by press-bending. An L-shaped base portion 5*a* of the terminal 5 is bent in an S-shaped configuration at one end thereof to form an elastic contact portion 5*b* adapted to contact the filament end of the bulb. Further, the base portion 5*a* is bent vertically downwardly at the other end to form a tab portion 5*c*. The tab portion 5*c* is folded at its free end to form a connecting portion 5*d* adapted to be connected to a connector (not shown). Thus, the terminal 5 is insert-molded under the condition where the elastic contact portion 5*b* extends in the bulb insertion hole 2 while the connecting portion 5*d* extends in the connector insertion hole 3.

More specifically, the elastic contact portion 5*b* of the terminal 5 is formed through a first bent portion $5b_1$ continued to the base portion 5*a*, a slant portion $5b_2$ continued to the first bent portion $5b_1$, and a second bent portion $5b_3$ formed at a free end of the slant portion $5b_2$. Thus, the formation of the first bent portion $5b_1$ and the second bent portion $5b_3$ provides a double spring-elasticity. Further, the first bent portion $5b_1$ is formed at its opposite side edges with a pair of shoulders $5b_4$, so that the elastic contact portion 5*b* and the slant portion $5b_2$ are made narrower than the base portion 5*a* as shown by dotted lines P. Further, a free end Q of the elastic contact portion 5*b* is positioned sufficiently inside of a bent edge Q' of the first bent portion $5b_1$, preferably inside the shoulders $5b_4$. As will be hereinafter described, opposite side edge portions R formed laterally outside the dotted lines P serve as a resin flow blocking wall at the time of insert-molding.

Figure 4B:
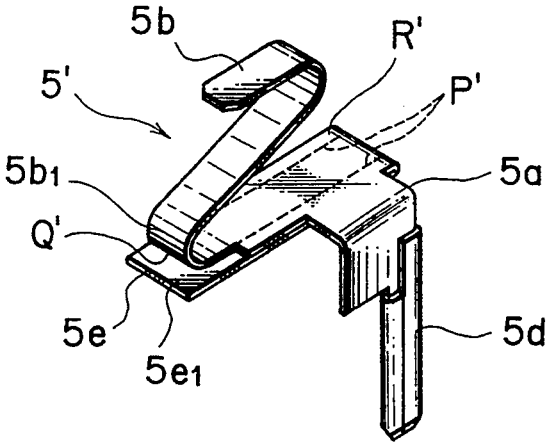
FIG. 4B is an enlarged perspective view of a modified form of the terminal 5.

FIG. 4B shows an improvement of the terminal 5 shown in FIG. 4A. In the terminal 5, there is a possibility that a molding pressure of resin will be applied to the base portion 5*a* at the time of insert-molding by a metal mold, causing bending of the base portion 5*a* toward the elastic contact portion 5*b* as will be hereinafter described. Referring to FIG. 4B, the base portion 5*a* of an improved terminal 5' is integrally formed with a reinforcing plate 5*e* as formed by folding the base portion 5*a* from the side remote from the elastic contact portion 5*b*. The reinforcing plate 5*e* projects slightly from the bent edge Q' of the first bent portion $5b_1$ which also serves as the resin flow blocking wall as well as opposite side edge portion R' formed laterally outside a pair of dotted lines P'. In this case, the opposite side edge portions R' may be omitted.

Figure 5:
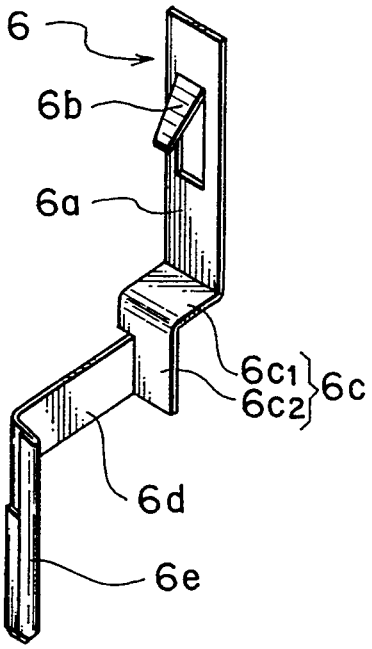
FIG. 5 is an enlarged perspective view of the earth terminal 6 shown in FIG. 1.
Figure 11:
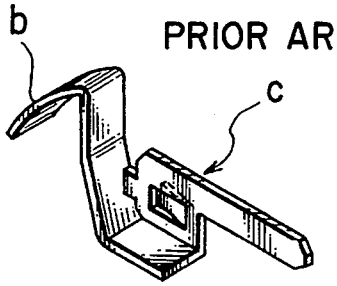
FIG.11 PRIOR ART
FIG. 11 is an enlarged perspective view of the terminal C shown in FIG. 8.
Figure 12:
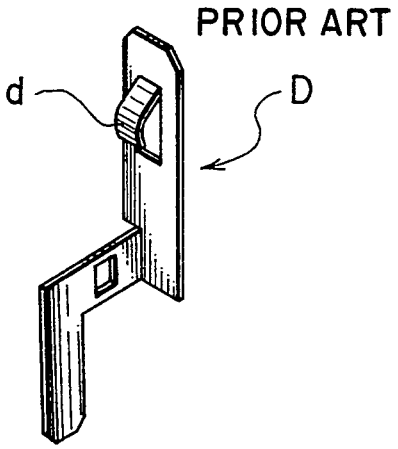
FIG.12 PRIOR ART
FIG. 12 is an enlarged perspective view of the ground terminal D shown in FIG. 8.

Referring to FIG. 5, a base portion 6*a* of the ground terminal 6 is partially cut to be inwardly bent so as to form an elastic contact portion 6*b* adapted to contact the ground of the bulb. Further, the base portion 6*a* is formed at its lower end with an L-shaped bent portion 6*c* consisting of a horizontal portion $6c_1$ and a vertical portion $6c_2$. A horizontal tab 6*d* extends from the vertical portion $6c_2$ in perpendicular relationship to the base portion 6*a*, and a connecting portion 6*e* to be connected to a connector (not shown) is foldedly formed at a free end of the horizontal tab 6*d*. Thus, the ground terminal 6 is insert-molded under the condition where the elastic contact portion 6*b* extends in the bulb insertion hole 2 while the connecting portion 6*e* extends in the connector insertion hole 3.

As will be hereinafter described, the horizontal portion $6c_1$ and the vertical portion $6c_2$ of the L-shaped bent portion 6*c* serve as the resin flow blocking wall.

In the case that the connector insertion hole 3 in FIGS. 2 and 3 is bent in an L-shaped configuration with respect to the bulb insertion hole 2, the connecting portions 5*d* of the terminals 5 or 5' and the connecting portion 6*e* of the terminal 6 may be similarly bent in an L-shaped configuration at the respective end portions.

Figure 6C:
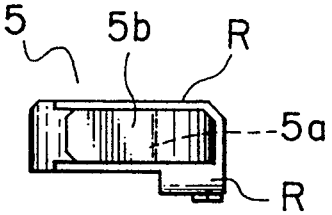
FIG. 6C is a plan view of FIG. 6A.
Figure 6A:
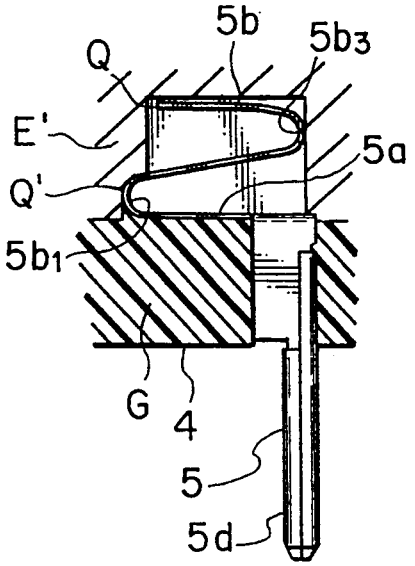
FIG. 6A is a sectional front view of the terminal 5 upon insert-molding with a metal mold shown in section.
Figure 6B:
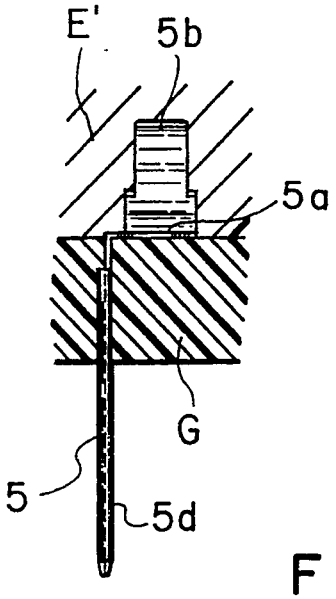
FIG. 6B is a sectional side view of FIG. 6A.

The operation of the preferred embodiment will now be described. As shown in FIGS. 6A to 6C, the elastic contact portion 5*b* of the terminal 5 is enclosed by a metal mold E' and the opposite side edge portions R formed from the base portion 5*a* to the first bent portion $5b_1$. Accordingly, resin is filled in a hatched area G which corresponds to an area where the partition wall 4 shown in FIGS. 2 and 3 is to be formed. That is, the resin is prevented from flowing into a space where the elastic contact portion 5*b* is allowed to be elastically displaced, by the opposite side edge portions R. Therefore, the spring elasticity of the elastic contact portion 5*b* will not be restricted by the resin molded, thus ensuring good contact with the fi lament of the bulb.

Similarly, the elastic contact portion 5*b* of the terminal 5' is enclosed by a metal mold (not shown) and the opposite side edge portions R' formed at the opposite side edges of the base portion 5*a* as well as the reinforcing portion 5*e*. In this case, a resin sealing effect can be doubled by the opposite side edge portions R' defined by dotted line P' and the reinforcing portion 5*e*. Furthermore, it is more advantageous that the base portion 5*a* is reinforced by the reinforcing portion 5*e*.

Figure 7A:
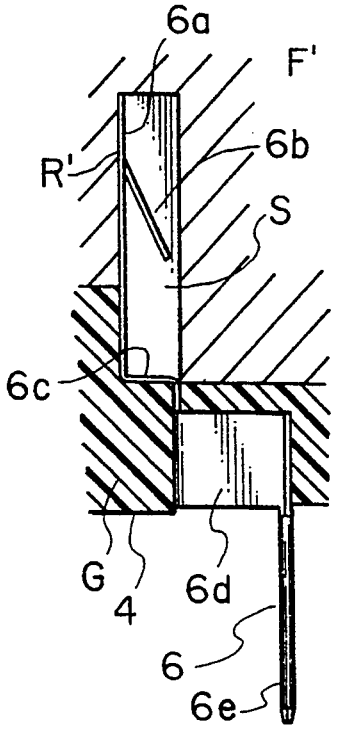
FIG. 7A is a sectional front view of the earth terminal 6 upon insert-molding with a metal mold shown in section.
Figure 7B:
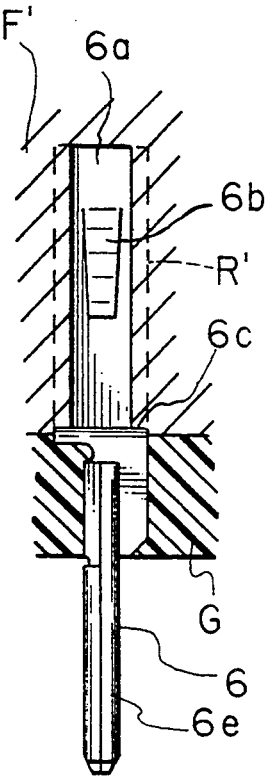
FIG. 7B is a sectional side view of FIG. 7A.

In a like manner, as shown in FIGS. 7A and 7B, a displacement space S of the elastic contact portion 6*b* of the ground terminal 6 is enclosed by a metal mold F' and the L-shaped bent portion 6*c* formed between the base portion 6*a* (inclusive of the elastic contact portion 6*b*) and the connecting portion 6*e* at an outside peripheral portion R' of the base portion 6*a* and the bent portion 6*c*. Accordingly, the resin is filled in a hatched area G only.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

What is claimed is:

1. A bulb socket terminal insertable into a metal mold prior to insert-molding of a socket body of a connector bulb socket for accommodating a bulb having a filament and a ground end, said terminal comprising:

a base;

an elastic contact portion connected to said base and for contacting with at least one of said filament end and said ground end of said bulb on one side of said base, wherein said elastic contact portion comprises a first bent portion extending from said base, a slant portion extending from said first bent portion, and a second bent portion formed at a free end of said slant portion;

a connecting portion connectable to a connector on a side of said base; and a resin flow blocking wall means integral to said base for sealing and blocking entry of resin into an area behind said elastic contact portion during insert-molding of said socket body of said connector bulb socket, said resin flow blocking wall means being formed between said elastic contact portion and said connecting portion and contacting an insert-molding metal mold for said socket body during insert-molding of said socket body of said connector bulb socket, wherein each of said first bent portion, said slant portion and said second bent portion is narrower than said base, and wherein said resin flow blocking wall means includes a reinforcing plate (5*e*) coupled to said base which extends laterally along said base and beyond a bent edge (Q′) of said first bent portion.

2. The bulb socket terminal as in claim 1, wherein said base includes a portion remote from said elastic contact portion which is folded to form said reinforcing plate integral to said base.

3. The bulb socket terminal as in claim 1, wherein said resin flow blocking wall means includes said reinforcing plate for preventing said elastic contact portion from deforming due to molding pressure during said insert molding.

* * * * *